US008891721B1

(12) United States Patent
Elizondo-Decanini

(10) Patent No.: US 8,891,721 B1
(45) Date of Patent: Nov. 18, 2014

(54) NEUTRON GENERATORS WITH SIZE SCALABILITY, EASE OF FABRICATION AND MULTIPLE ION SOURCE FUNCTIONALITIES

(75) Inventor: Juan M. Elizondo-Decanini, Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 703 days.

(21) Appl. No.: 13/075,817

(22) Filed: Mar. 30, 2011

(51) Int. Cl.
*G21G 1/10* (2006.01)
*G21G 4/02* (2006.01)

(52) U.S. Cl.
USPC ..... 376/191

(58) Field of Classification Search
None
See application file for complete search history.

(56) References Cited

U.S. PATENT DOCUMENTS 4,895,062 A * 1/1990 Chryssomallis et al. ..... 89/7
4,910,397 A 3/1990 Mills, Jr. et al.
4,996,017 A 2/1991 Ethridge
5,078,950 A 1/1992 Bernadet et al.
5,745,537 A 4/1998 Verschoore
6,141,395 A 10/2000 Nishimura et al.
7,639,770 B2 12/2009 Leung
7,710,051 B2 * 5/2010 Caporaso et al. ..... 315/505
2008/0080659 A1 4/2008 Leung et al.
2009/0046823 A1 2/2009 Edwards et al.
2009/0108192 A1 * 4/2009 Groves ..... 250/269.4
2009/0135982 A1 5/2009 Groves
2009/0146052 A1 6/2009 Groves et al.
2012/0106690 A1 * 5/2012 Tang et al. ..... 376/111

OTHER PUBLICATIONS

S. Sampayan et al., High Gradient Multilayer Insulator Technology, 2004 Power Modulator Conference, San Francisco, CA (2004), available at https://e-reports-ext.llnl.gov/pdf/308359.pdf.*

* cited by examiner

*Primary Examiner* — Jack W Keith
*Assistant Examiner* — Kimberly E Coghill
(74) *Attorney, Agent, or Firm* — Michael A. Beckett

(57) ABSTRACT

A neutron generator is provided with a flat, rectilinear geometry and surface mounted metallizations. This construction provides scalability and ease of fabrication, and permits multiple ion source functionalities.

14 Claims, 6 Drawing Sheets

NEUTRON GENERATORS WITH SIZE SCALABILITY, EASE OF FABRICATION AND MULTIPLE ION SOURCE FUNCTIONALITIES

This invention was developed under Contract DE-AC04-94AL85000 between Sandia Corporation and the U.S. Department of Energy. The U.S. Government has certain rights in this invention.

FIELD

The present work relates generally to neutron generators and, more particularly, to neutron generator designs that provide size scalability, ease of fabrication and multiple ion source functionalities.

BACKGROUND

The utility of neutron generators in various endeavors is well known. Neutron generators are commonly used, for instance, in areas as diverse as oil well logging applications, and treatment/monitoring of medical conditions. Conventional high fluence, non-active, neutron generator technology is mostly based on vacuum accelerator or RF techniques. The most basic neutron generator uses high voltage to accelerate deuterium (D) ions. The accelerated ions impact on a metal target loaded with tritium (T) gas, causing a deuterium-tritium (DT) fusion reaction that produces neutrons. Such devices appeared in the literature in the early 1960's, and the design continues to evolve with variations on the accelerator type, power supply driver type, size, and output.

A conventional neutron generator includes 1) a deuterium ion source, 2) an accelerating cavity, also termed an acceleration gap, or drift region, 3) an extraction plate disposed between the ion source region and the accelerating cavity, including an aperture for extracting the ions, and 4) the aforementioned metal target loaded with tritium. Most commercial deuterium ion sources are of the Penning type, which produces ions by heating a filament of wire (e.g., titanium) that has been hydrided with deuterium. As the temperature of the wire increases, the deuterium is released from the metal as a gas that is then ionized by a spark produced between a pair of electrodes. The deuterium ions are channeled through the aperture into the acceleration gap. At the end of the acceleration gap is the metal (e.g., titanium) target, which has been hydrided with tritium. The deuterium ions are accelerated across the gap by a high voltage applied between the extraction plate and the target.

Conventional neutron generators typically use a cylindrically symmetric discharge geometry, and are thus commonly referred to as neutron tubes. The cylindrical geometry facilitates ion beam control and symmetrical radial beam expansion. This symmetric geometry, although simple and effective, is not easily scaled down, thereby disadvantageously limiting the possibilities of size reductions.

It is desirable in view of the foregoing to provide a neutron generator that avoids disadvantages associated with prior art neutron generators.

DETAILED DESCRIPTION

Figure 1A:
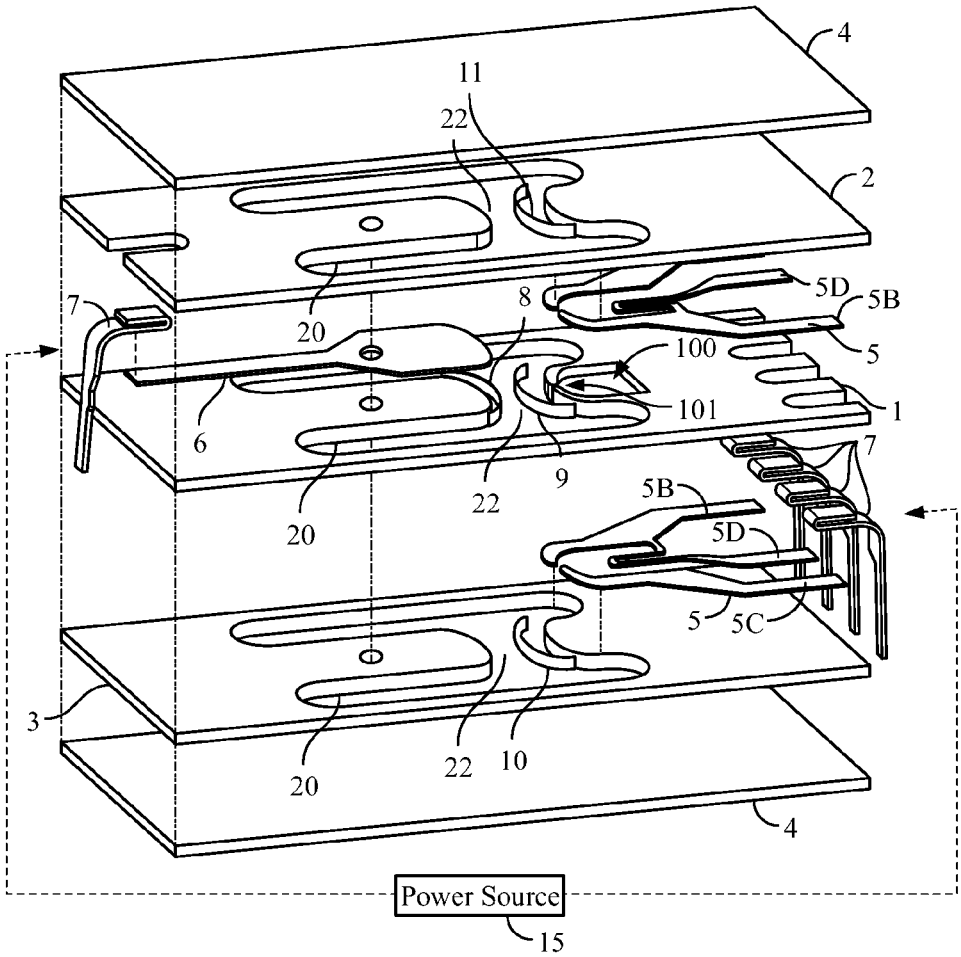
FIG. 1A diagrammatically illustrates an exploded top perspective view of a neutron generator according to exemplary embodiments of the present work.

Exemplary embodiments of the present work provide a neutron generator having a flat, rectilinear geometry with surface mounted metallizations. This construction may be scaled down as desired, to as small as a micron size package, while maintaining a relatively high output. Some embodiments provide the same functional elements as in the conventional cylindrical geometry, but embodied in a flat arrangement of stacked dielectric layers that provide design flexibility at different neutron output levels. The ion source uses a pulse heating process to produce ions from flat strip metallizations deposited on dielectric substrates. Two electrodes face one another across a spark gap where an arc is produced to ionize deuterium gas. The electrodes also serve as filaments that release the deuterium gas when heated. As such, in some embodiments, the electrodes are made of titanium that has been hydrided or loaded with deuterium. A power source applies a high-voltage/high-current pulse to the electrodes, and the resulting joule heating releases the deuterium. The power source pulses with sufficient current and pulse width to produce the heating required to release the deuterium gas.

The deuterium gas is released into a vacuum-sealed expansion cavity, and the pulsed voltage applied across the electrodes produces therebetween an arc to ionize the gas. The power source pulses have sufficient current and pulse width to sustain the arc so that the gas is ionized nearly simultaneously with its release. Accordingly, accumulation of background deuterium gas, which is known to limit system output in Penning-type ion sources, does not occur.

The above-described dual use of electrodes as arcing elements for ionization and as filaments for releasing deuterium gas, as well as the above-described pulsing to produce the near simultaneous release and ionization of deuterium gas, are known from conventional neutron tube arrangements. However, the aforementioned use of flat strip metallization electrodes imposes power requirements commensurate with the flat strip construction. The required current and the required pulse length are readily calculated based on the thickness and length of the electrodes. For example, in various embodiments, the pulse width ranges in length from 10 nanoseconds to several microseconds, and the power source provides pulses in a range of 1 kV at 0.1 amps to 5 kV at 1 amp.

The ionization operation produces in the expansion cavity an ion-rich plasma that expands toward an aperture in an extraction plate at one end of the expansion cavity. The aperture extracts the deuterium ions through operation of a voltage gradient provided by biasing the target to a higher voltage than the extraction plate. The aperture rejects electrons back into the plasma. The voltage gradient accelerates the extracted deuterium ions in an acceleration direction across an acceleration gap to the tritium-loaded target. When the deuterium ions impact the target, neutrons are produced by a conventional deuterium-tritium collision reaction.

Figure 1B:
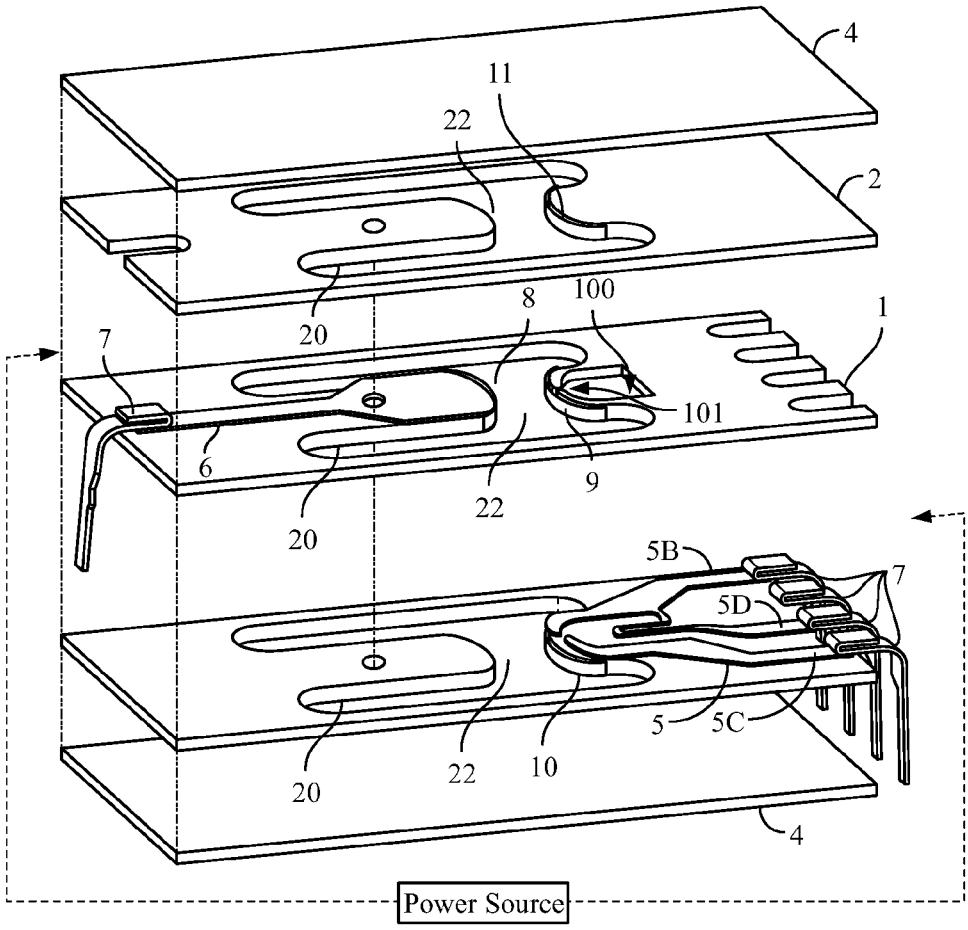
FIG. 1B diagrammatically illustrates a top perspective view of the separated layers of the neutron generator according to exemplary embodiments of the present work.
Figure 1C:
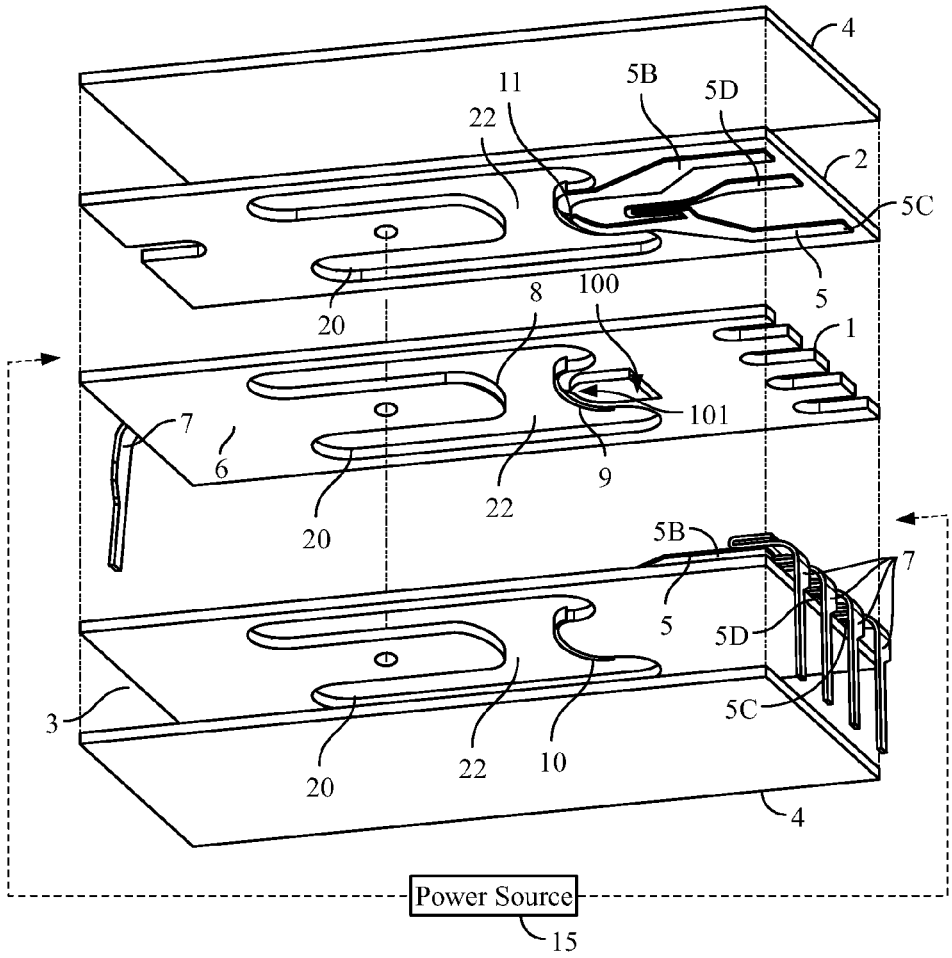
FIG. 1C diagrammatically illustrates a bottom perspective view of the separated layers of the neutron generator according to exemplary embodiments of the present work.

As shown in FIGS. 1A-1C, a neutron generator structure according to exemplary embodiments of the present work includes a plurality of dielectric substrate layers in a stacked arrangement. This stacked (i.e., layered or laminated) structure facilitates fabrication and size scaling. In some embodiments, all of the layers have a generally uniform rectangular size, shape and thickness, as shown in FIGS. 1A-1C. In various embodiments, the substrate layers are formed from a ceramic substrate material, a printed circuit board substrate material, or a semiconductor substrate material. In various embodiments, the layers range in thickness from approximately 0.5 mm to 3 mm and thicker. In some embodiments, the rectangular dimensions of the layers have approximately a 2:1 ratio, for example, 15×30 mm. The exploded view of FIGS. 1A-1C shows an example of five layers stacked successively upon one another.

The stack structure of shown in the example of FIGS. 1A-1C includes a stack of three interior layers 1-3 disposed between two outer cover layers 4 that define opposite ends of the stack. In this example, the interior layers 1-3 have provided therein generally H-shaped openings that are substantially centrally located within the respective layers and substantially aligned within the laminate structure to produce a composite, H-shaped cavity having a height of three layers. As will be apparent from description which follows, the ion acceleration gap 22 (between extraction plate and target) is located in the "cross bar" portion of the H-shaped cavity 20. In various embodiments, the distance across the acceleration gap 22 (i.e., the width of the cross bar portion from left to right in FIG. 1) ranges from 3-20 mm. In some embodiments, the layers have rectangular dimensions of 15×30 mm, and the "legs" of the H-shaped openings have a length of approximately 12 mm. It will be evident to workers in the art that the H-shaped acceleration gap cavity 20 is provided as an expository example only. In various embodiments, openings of various different shapes provide the acceleration gap cavity 20 (see also FIG. 4).

Layer 1, the middle layer of the stack structure, has provided therein a further opening 100 that is located adjacent the H-shaped opening of layer 1. In the example of FIGS. 1A-1C, the opening 100 is generally rectangular on three sides, and curved on the side adjacent the acceleration cavity. The opening 100 provides the plasma expansion cavity for the neutron generator. A relatively narrow notch 101 in the curved side of the opening 100 provides spatial communication between the acceleration cavity and the expansion cavity (see also FIG. 2). As described below, the notch 101 corresponds to the extraction plate aperture of the neutron generator. In some embodiments, the opening 100 has dimensions of approximately 3 mm in the left to right direction, and approximately 4 mm in the front to back direction.

Some embodiments provide for a higher volume plasma expansion cavity (and correspondingly higher plasma densities and ion beam currents) by providing in interior layers 2 and 3 additional openings 100 that are aligned (in the stacking direction of the stacked structure) with the opening 100 of middle layer 1. Some embodiments provide one or more duplicates of layer 3. The volume of the acceleration gap cavity 20 is increased by providing such additional duplicate(s) of layer 3. Some embodiments provide one or more additional layers like layer 3, but also including an opening 100. The volumes of both the acceleration gap cavity 20 and the expansion cavity are increased by providing such additional layer(s). In various embodiments where the layers are approximately 15×30 mm rectangles, the acceleration gap 22 (i.e., the "cross-bar" portion of the composite H-shaped opening) has generally rectangular dimensions, as viewed in cross-section from left to right, that range from 3-9 mm in each direction. In various embodiments, the expansion cavity dimension in the stacking direction ranges from 1-9 mm.

Operation of the neutron generator is controlled via five electrical terminals designated generally by 7 in FIGS. 1A-1C. Layer 1 has provided therein, at and end thereof adjacent the opening 100, four notches that respectively accommodate four of the electrical terminals 7. As described in detail below, the terminals accommodated by the notches in layer 1 are used to drive the ion source and bias the extraction plate. Layer 2 has provided therein, at an end thereof opposite the notches of layer 1, a notch that accommodates the fifth terminal 7. As described below, this terminal is used to bias the target.

FIGS. 1A-1C further illustrate seven surface metallizations. In some embodiments, the metallizations are provided by conventional photolithographic techniques such as used, for example, in the fabrication of printed circuit boards. Three of the metallizations are longitudinal metallizations provided on longitudinal surfaces of the layers that face generally in the stacking direction of the stacked structure. Four of the metallizations are transverse metallizations provided on transverse surfaces of the layers that face generally transversely to the stacking direction. Transverse metallization 8 defines the target, for example, a tritium-loaded titanium metallization. The metallization 8 is provided on an elliptically curved transverse surface of middle layer 1 that faces across the ion acceleration gap 22 toward the opening 100. Longitudinal metallization 6 is an electrically conductive metallization provided on the longitudinal surface of layer 1 that faces layer 2. The metallization 6 electrically connects the target metallization 8 to the terminal 7 received in the notch of layer 2.

Electrically conductive transverse metallizations 10 and 11 are respectively provided on elliptically curved transverse surfaces of layers 3 and 2 that are spatially aligned with one another in the stacking direction, and face across the acceleration gap cavity 20 toward the target metallization 8 on layer 1. Electrically conductive transverse metallization 9 is a two-part metallization. The component parts of metallization 9 are respectively provided on elliptically curved transverse surfaces of layer 1 that are adjacent notch 101. These elliptically curved transverse surfaces of layer 1 are spatially aligned in the stacking direction with the aforementioned elliptically curved transverse surfaces of layers 2 and 3, and face across the acceleration gap cavity 20 toward the target metallization 8.

Figure 2:
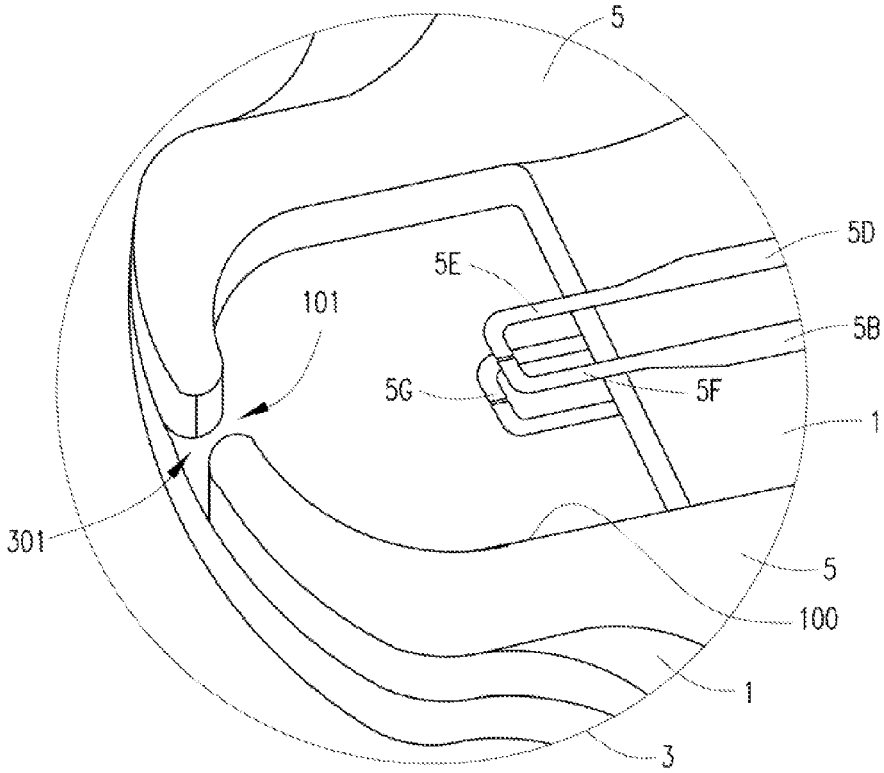
FIGS. 2 and 3 illustrate respective portions of FIG. 1 in more detail.
Figure 3:
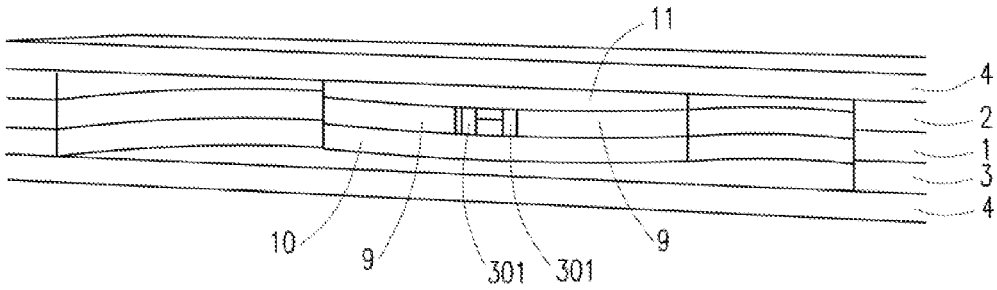

Each component part of metallization 9 includes at one end a generally hook-shaped portion that wraps around into the notch 101 such that each hook-shaped portion faces the other across the notch 101 (see also FIG. 2). The metallizations 9-11 contact one another by virtue of the layer stacking, and they define collectively the extraction plate of the neutron generator, as shown in FIG. 3. The wrap-around hook-shaped portions of the metallization 9 (shown at 301 in FIGS. 2 and 3) provide the aperture in the extraction plate. In various embodiments, the aperture width (i.e., the distance between the hook-shaped portions 301) ranges from 0.25-2 mm.

Electrically conductive longitudinal metallizations 5 are respectively provided on longitudinal surfaces of layers 2 and 3 that face layer 1. Each of the two metallizations 5 is a three-part metallization, including parts 5B and 5C which electrically connect the aperture plate defined by metallizations 9-11 to respective ones of the terminals 7 received in the notches of layer 1. Each metallization 5 also forms a dual function ion source electrode/filament structure. As such, the metallizations 5 are (in some embodiments) constituted of titanium hydrided with deuterium. In particular, one part 5D of each metallization 5 extends into the expansion cavity defined by the opening 100 in the middle layer 1, and terminates in a generally hook-shaped portion 5E (see also FIG. 2). Each part 5B includes a structure that also extends into the expansion cavity, and terminates in a generally hook-shaped portion 5F. Each of the hook-shaped portions 5E and 5F of each metallization 5 provides the dual functions of deuterium release filament and ion source electrode. As such, the hook-shaped portions 5E and 5F of each metallization 5 operate as deuterium release filaments of the ion source, and also cooperate to form the electrode pair of the ion source. Each electrode of the pair terminates adjacent the other in the expansion cavity to define a spark gap 5G.

The two metallizations 5 shown in FIGS. 1A-1C have generally the same structure, but are provided in opposite spatial orientations. More specifically, the orientation of the metallization 5 formed on layer 2 is flipped, i.e. rotated 180 degrees about a central longitudinal axis thereof, relative to the orientation of the metallization 5 formed on layer 3. Each spark gap 5G is located on a generally central longitudinal axis of the associated metallization 5, so the spark gaps 5G are generally aligned with one another in the stacking direction as shown in FIG. 2, despite the relative 180-degree rotation. It can be seen from FIGS. 1A-C and 2 that the aligned spark gaps 5G generally define a plane that extends left to right and in the stacking direction, and substantially bisects the extraction plate aperture 101. To reduce the incidence of metal particles from the arc material escaping from the expansion cavity into the acceleration cavity, some embodiments provide the spark gaps 5G laterally offset from the central longitudinal axis of the metallizations 5.

As seen from FIGS. 1A-1C, the parts 5B and 5C respectively connect the extraction plate defined by metallizations 9-11 to opposite outer ones of the terminals 7 received in the notches of layer 1. These outer two terminals 7 are used to electrically control the extraction plate formed by metallizations 9-11. The parts 5D of the metallizations 5 on layers 2 and 3 are respectively connected to different ones of the inner two terminals 7 received in the notches of layer 1. Thus, one of the ion source electrode pairs is electrically controlled via one of the outer two terminals 7 and one of the inner two terminals 7, and the other of the ion source electrode pairs is controlled by the other of the outer two terminals and the other of the inner two terminals. A power source 15 drives the terminals 7 of FIGS. 1A-1C.

Figure 8:
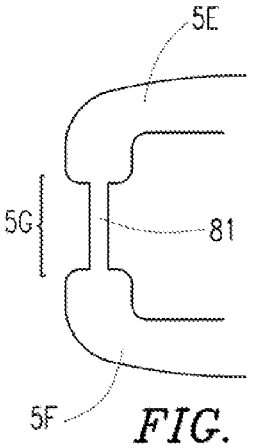
FIG. 8 diagrammatically illustrates an ion source electrode structure including a fuse bridge according to exemplary embodiments of the present work.

Some embodiments ensure that the arcing across the spark gaps 5G may be produced by a relatively low voltage by, for example, setting the spark gaps 5G to a width of about 1 micron. As an example, some embodiments produce arcing with spark gap voltages ranging from 10-100 volts. As shown in FIG. 8, in some embodiments, the hook-shaped parts 5E and 5F are initially connected by a small bridging fuse 81 that burns away at the time of the first operation of the ion source. The fuse 81 is provided as a part of the metallization 5 that is significantly narrowed relative to the hook-shaped parts 5E and 5F. Although not shown to scale in FIG. 8, the fuse portion 81 is about 1/10 the width of the parts 5E and 5F in some embodiments, and 1/20 the width of parts 5E and 5F in other embodiments. The fuse portion 81 has various widths in various embodiments. The fuse portion 81 is narrow enough that the current density burns it away.

Various embodiments having various numbers of ion sources are readily produced by supplementing an arrangement such as shown in FIGS. 1A-1C with additional layers to increase the volume of the expansion cavity (as explained above), and providing additional dual function electrode pairs on the additional layers. Although some embodiments provide a neutron generator having only a single ion source, two or more ion sources provide a number of advantages relative to single ion source embodiments. The following examples are illustrative.

Figure 5:
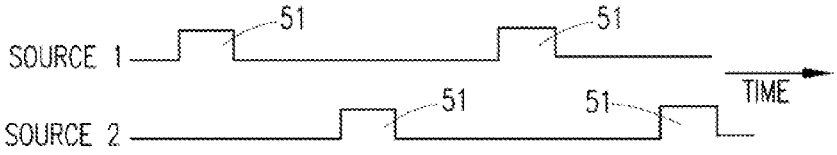
FIGS. 5-7 graphically illustrate examples of arcing operations performed using multiple ion sources according to exemplary embodiments of the present work.
Figure 6:
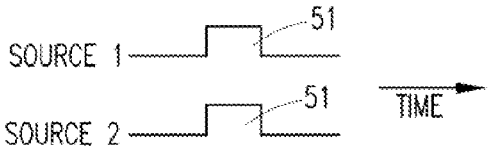
Figure 7:
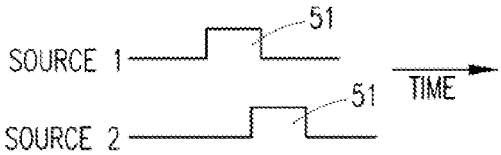

Some embodiments implement arc repetition by arcing the ion sources in alternating fashion, such that a sequence of arcs separated in time by a selected time interval occurs. This is shown for two ion sources in the simplified example of FIG. 5, wherein 51 graphically designates the arcing of an ion source. Some embodiments provide increased-power arcs by arcing two (or more) ion sources substantially simultaneously, as shown for two ion sources in the example of FIG. 6. Some embodiments provide a sequence of arcs analogous to the sequence of FIG. 5, but composed instead of increased-power arcs such as shown in FIG. 6. Some embodiments obtain an extended-length arc by arcing one ion source after, but in temporally overlapping relationship with, the arcing of another ion source, as shown for two ion sources in the example of FIG. 7. Some embodiments provide a sequence of arcs analogous to the sequence of FIG. 5, but composed instead of extended-length arcs such as shown in FIG. 7. Various embodiments that include multiple ion sources are capable of combining the techniques of FIGS. 6 and 7 to provide arcs having both increased power and extended length. Some embodiments provide a sequence of arcs analogous to that of FIG. 5, but composed instead of arcs having both increased power and extended length.

The outer cover layers 4 of FIGS. 1A-1C are solid, without any openings. These cover layers 4 enclose the expansion cavity and the acceleration gap cavity 20, and permit those cavities to be vacuum-sealed. Various embodiments seal the laminate structure according to conventional techniques, for example, techniques such as used to seal stacks of printed circuit boards or stacks of integrated circuits. In some embodiments, the assembled neutron generator package is similar in size and shape to a computer chip socket. In some embodiments, the power source 15 is integrated into the laminate structure.

As is evident from FIGS. 1A-1C, the ion acceleration gap 22 defined within the composite H-shaped cavity has a generally rectangular cross-section. As such, the ion beam should preferably have a cross section that is generally rectangular rather than cylindrical. A conventional cylindrical ion beam would spread over the lateral walls and cause high voltage breakdown. Shaping the ion beam in a rectangular cross section is similar, in the optical sense, to using a cylindrical lens to transform a circular cross section light beam into a rectangular, flat cross section beam. Exemplary embodiments of the present work provide an ion beam lens produced by the electric field distribution around the extraction plate aperture. This lens provides beam shaping to produce a generally flat, rectangular ion beam.

Some embodiments implement the ion beam lens as follows. As indicated above, the metallizations 8-11 conform to the curvature of the corresponding elliptically shaped transverse surfaces of layers 1-3 on which they are deposited. Thus, the metallizations 8, 10 and 11 define ellipses, and the metallization 9 defines two truncated ellipses, each of which terminates in the hook-shaped portion 301 wrapping into the extraction plate aperture at 101. The parameters of the ellipses at 9-11 are related to the size and elliptical shape of the target metallization 8, and the ion acceleration gap 22 distance. The elliptically shaped extraction plate (9-11) is biased to ground or another fixed potential, and the elliptically shaped target 8 is biased to a much higher potential. For example, various embodiments bias the target 8 to various voltages ranging from 10 kV to 50 kV. This biasing of the elliptically shaped metallizations produces in the acceleration gap cavity 20 an electric field that tends to force the ion beam to be flat. The elliptically shaped extraction plate allows the ion beam to spread laterally as it proceeds toward the elliptically shaped target 8, thereby substantially covering the corresponding lateral (front to back in FIGS. 1A-1C) dimension of the target.

The dimensions of the target 8, as well as the ion current and the target-to-extraction plate voltage, are dictated by the desired neutron output level. The required voltage dictates the acceleration gap 22 distance, and the required ion current dictates the width of the extraction plate aperture. After all dimensions are set, the extraction plate ellipse is designed such that the ion beam covers about 80% of both dimensions of the target metallization 8. Some embodiments incorporate a dimensional tolerance factor to reduce the likelihood that the ion beam will strike the cavity surfaces.

In various embodiments, the dimensions of the target metallization 8 range from 1-10 mm in the stacking direction and 1-20 mm in the front to back direction of FIGS. 1A-1C, and the elliptical curvature of the target metallization 8 is tailored to those dimensions as a 2:1; 3:1, or 4:1 semi-major to semi-minor elliptical axis ratio. In various embodiments, the extraction plate (metallizations 9-11) has elliptical axis ratios similar to those of the target 8, but tailored to the acceleration gap 22 distance such that the beam does not spread beyond about 80% of the target metallization dimensions.

In some embodiments, layers 1-3 are formed such that the conforming metallizations 9-11 have generally linear (straight) profiles as viewed in the stacking direction (rather than the elliptically-shaped profiles shown in FIGS. 1A-1C). In various embodiments, the stacking direction profiles of each metallization 9-11 has a generally linear central portion, but with curved portions at opposite ends of the linear portion. These curved portions of the profile present convex metal surfaces facing into the ion acceleration cavity. The size and shape of the convex surfaces may be tailored as desired to provide various corresponding focus options for the ion beam. For example, in some embodiments, the convex surfaces protrude forwardly (toward the target 8) from the central linear portion of the profile. Although the stacking direction profile of the two-part metallization 9 exhibits the aforementioned central linear portion in various embodiments, it retains the same curved central aperture structure shown at 301 in FIGS. 2 and 3.

Figure 4:
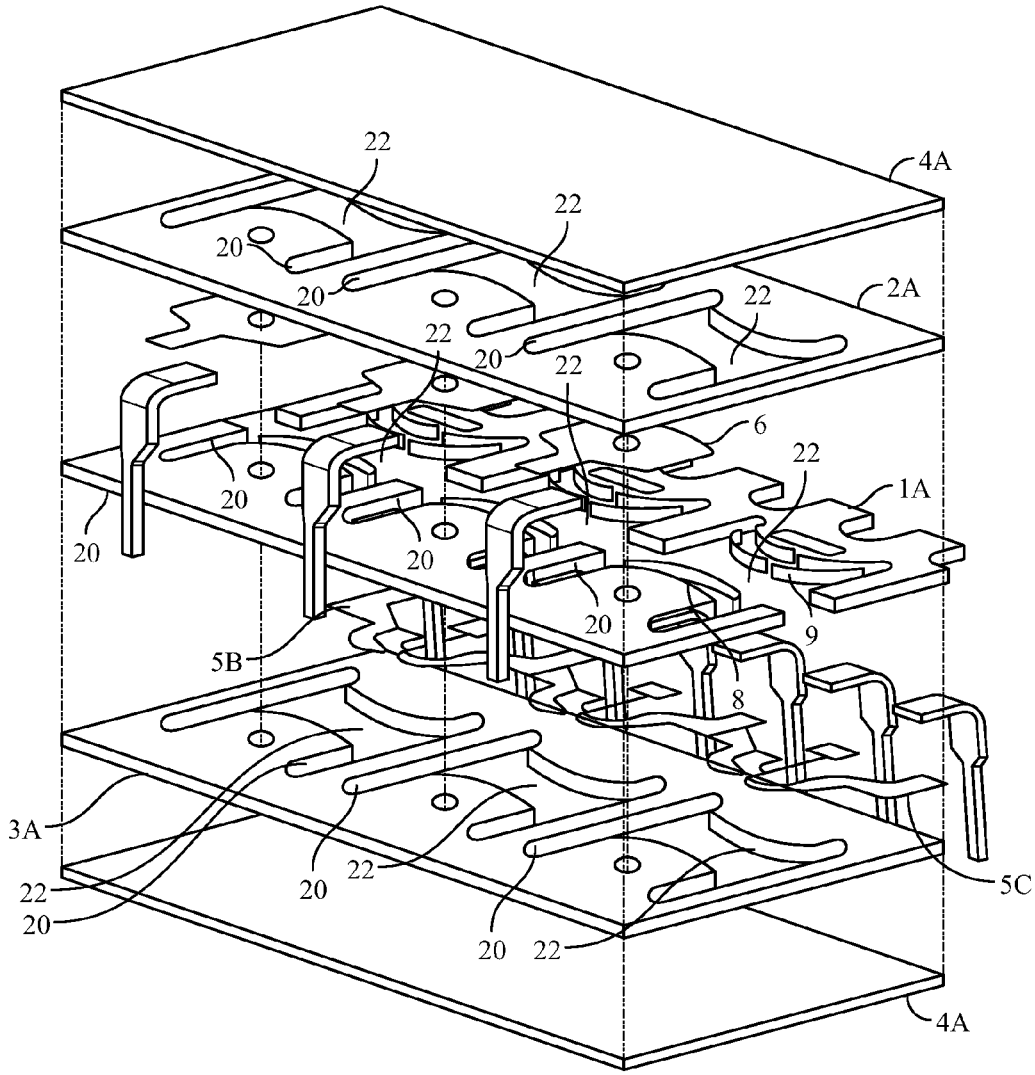
FIG. 4 diagrammatically illustrates fabrication of a plurality of neutron generators according to exemplary embodiments of the present work.

It will be evident that a complete set of neutron generator components, for example, the set shown in FIGS. 1A-1C, may be produced during a single fabrication run. As shown by the example of FIG. 4, some embodiments produce during a single fabrication run multiple complete sets of neutron generator components suitable for constructing multiple neutron generators. Component layers 1A-4A of FIG. 4 can be seen as generally corresponding to component layers 1-4, respectively, of FIGS. 1A-1C. Note that each of the multiple neutron generators shown in FIG. 4 is an example of aforementioned embodiments that have only a single ion source (i.e., only one of the spark gaps 5G of FIG. 2). In FIG. 4, because each of the neutron generators has only a single ion source, and because the portions 5B and 5C of adjacent metallizations 5 are commonly connected, the three illustrated neutron generators are controlled using only eight terminals 7. Thus, the control terminal to neutron generator ratio is 8:3 in FIG. 4, whereas the corresponding ratio in FIG. 1 is 5:1.

In some embodiments, at least two of the multiple sets of components produced during a single fabrication run define respective neutron generators that differ from one another in at least one physical parameter (e.g., the acceleration gap distance).

Figure 9:
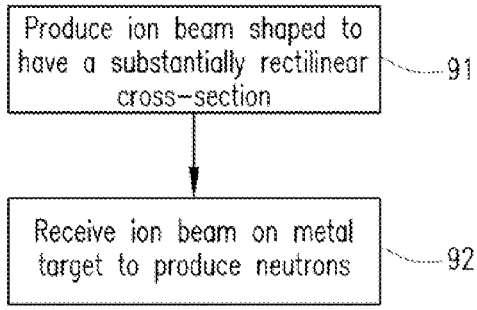
FIG. 9 illustrates neutron generation operations that may be performed according to exemplary embodiments of the present work.

FIG. 9 illustrates operations that may be performed according to exemplary embodiments of the present work. At 91, an ion beam is produced, shaped to have a substantially rectilinear cross section. At 92, the ion beam is intersected with a metal target to produce neutrons.

Although exemplary embodiments of the present work are described above in detail, this does not limit the scope of the work, which can be practiced in a variety of embodiments.

What is claimed is:

1. A neutron generator apparatus, comprising:

means defining an expansion cavity;

an ion source disposed in said expansion cavity for producing ions in said expansion cavity;

means defining an acceleration gap cavity;

a metal extraction plate interposed between said expansion cavity and said acceleration gap cavity and having defined therein an aperture for channeling said ions from said expansion cavity into said acceleration gap cavity; and a metal target disposed in said acceleration gap cavity and separated from said extraction plate by an acceleration gap, said target and said extraction plate adapted to be biased relative to one another to accelerate said ions across said acceleration gap in an acceleration direction to strike said target, said target adapted to release neutrons in response to being struck by said accelerated ions;

wherein said acceleration gap cavity has a rectilinear cross section in said acceleration direction.

2. The apparatus of claim 1, wherein said extraction plate includes a surface metallization deposited on a substrate, generally defining an ellipse, and facing said target.

3. The apparatus of claim 2, wherein said target includes a surface metallization deposited on a substrate, generally defining an ellipse, and facing said surface metallization of said extraction plate.

4. The apparatus of claim 1, wherein said accelerated ions form an ion beam having a generally rectilinear cross section in said acceleration direction.

5. The apparatus of claim 1, wherein said ion source includes a pair of surface metallization electrodes deposited on a substrate and separated by a spark gap.

6. The apparatus of claim 1, wherein said means defining said expansion cavity and said means defining said acceleration gap cavity include a substrate, and wherein said target and said extraction plate include respective metallizations deposited on said substrate.

7. The apparatus of claim 6, wherein said means defining said expansion cavity and said means defining said acceleration gap cavity include a plurality of substrate layers laminated together.

8. The apparatus of claim 6, wherein said substrate is one of a ceramic substrate, a semiconductor substrate and a printed circuit board substrate.

9. A neutron generator apparatus, comprising:

means defining an expansion cavity;

an ion source disposed in said expansion cavity for producing ions in said expansion cavity;

means defining an acceleration gap cavity;

a metal extraction plate interposed between said expansion cavity and said acceleration gap cavity and having defined therein an aperture for channeling said ions from said expansion cavity into said acceleration gap cavity; and a metal target disposed in said acceleration gap cavity and separated from said extraction plate by an acceleration gap, said target and said extraction plate adapted to be biased relative to one another to accelerate said ions across said acceleration gap in an acceleration direction to strike said target, said target adapted to release neutrons in response to being struck by said accelerated ions;

wherein said extraction plate includes a surface metallization deposited on a substrate, generally defining an ellipse, and facing said target.

10. The apparatus of claim 9, wherein said target includes a surface metallization deposited on a substrate, generally defining an ellipse, and facing said surface metallization of said extraction plate.

11. The apparatus of claim 10, wherein said ion source includes a pair of surface metallization electrodes deposited on a substrate and separated by a spark gap.

12. A neutron generator apparatus, comprising:

means defining an expansion cavity;

an ion source disposed in said expansion cavity for producing ions in said expansion cavity, including a pair of surface metallization electrodes deposited on a substrate and separated by a spark gap;

means defining an acceleration gap cavity;

a metal extraction plate interposed between said expansion cavity and said acceleration gap cavity and having defined therein an aperture for channeling said ions from said expansion cavity into said acceleration gap cavity; and a metal target disposed in said acceleration gap cavity and separated from said extraction plate by an acceleration gap, said target and said extraction plate adapted to be biased relative to one another to accelerate said ions across said acceleration gap in an acceleration direction to strike said target, said target adapted to release neutrons in response to being struck by said accelerated ions.

13. A neutron generator apparatus, comprising:

means defining an expansion cavity;

an ion source disposed in said expansion cavity for producing ions in said expansion cavity, including a pair of electrodes separated by a spark gap, and a fuse that bridges across said spark gap and is burned away upon initial application of power to said electrodes;

means defining an acceleration gap cavity;

a metal extraction plate interposed between said expansion cavity and said acceleration gap cavity and having defined therein an aperture for channeling said ions from said expansion cavity into said acceleration gap cavity; and a metal target disposed in said acceleration gap cavity and separated from said extraction plate by an acceleration gap, said target and said extraction plate adapted to be biased relative to one another to accelerate said ions across said acceleration gap in an acceleration direction to strike said target, said target adapted to release neutrons in response to being struck by said accelerated ions.

14. The apparatus of claim 13, wherein said electrodes are provided as surface metallizations deposited on a substrate.

* * * * *